US012351372B2

(12) United States Patent
Spitler

(10) Patent No.: US 12,351,372 B2
(45) Date of Patent: Jul. 8, 2025

(54) CARTON WITH RECLOSABLE FEATURES

(71) Applicant: Graphic Packaging International, LLC, Atlanta, GA (US)

(72) Inventor: Donald Spitler, Buford, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 99 days.

(21) Appl. No.: 18/105,487

(22) Filed: Feb. 3, 2023

(65) Prior Publication Data

US 2023/0249873 A1 Aug. 10, 2023

Related U.S. Application Data

(60) Provisional application No. 63/307,313, filed on Feb. 7, 2022.

(51) Int. Cl.
*B65D 5/66* (2006.01)
*B65D 5/54* (2006.01)

(52) U.S. Cl.
CPC ..... *B65D 5/6608* (2013.01); *B65D 5/541* (2013.01)

(58) Field of Classification Search
CPC ..... B65D 5/66; B65D 5/6602; B65D 5/6608; B65D 5/0227; B65D 5/0254; B65D 2401/15; B65D 5/541; B65D 5/5455
USPC ..... 229/137, 138, 140, 148, 129, 102, 126, 229/141, 142, 149, 152–154, 215; 222/528
See application file for complete search history.

(56) References Cited

U.S. PATENT DOCUMENTS

| | | | | |
|---|---|---|---|---|
| 83,812 | A | | 11/1868 | Wilcox |
| 362,583 | A | | 5/1887 | Jordan |
| 567,649 | A | | 9/1896 | Lanzit |
| 1,082,868 | A | | 12/1913 | Hollett |
| 1,277,459 | A | * | 9/1918 | Name not available ..... B65D 5/6661 229/148 |

(Continued)

FOREIGN PATENT DOCUMENTS

| | | |
|---|---|---|
| DE | 29 23 455 | 12/1980 |
| DE | 81 10 323.9 | 9/1981 |

(Continued)

OTHER PUBLICATIONS

International Search Report and Written Opinion for PCT/US2023/012297 dated May 30, 2023.

*Primary Examiner* — Nathan J Newhouse
*Assistant Examiner* — Phillip D Schmidt
(74) *Attorney, Agent, or Firm* — FisherBroyles, LLP

(57) ABSTRACT

A carton for holding at least one article, the carton including a plurality of side panels extending at least partially around an interior of the carton, a plurality of end flaps foldably connected to a respective side panel of the plurality of side panels, the plurality of end flaps at least partially overlapped to form at least one reclosable end of the carton, the plurality of end flaps including at least one top end flap foldably connected to at least one side panel of the plurality of side panels and having a base portion foldably connected to a distal portion, and a reconfigurable lid including the at least one top end flap, the reconfigurable lid for at least partially overlying the interior of the carton when the carton is in an open configuration, the reconfigurable lid for forming a dispenser when the carton is in a closed configuration.

24 Claims, 5 Drawing Sheets

(56) References Cited

U.S. PATENT DOCUMENTS 1,772,625 A 8/1930 Caulfield
2,192,722 A 3/1940 Vogt
2,331,754 A * 10/1943 Wohlers ..... B65D 5/6608 229/160
2,355,665 A 8/1944 Mabee
2,475,677 A 7/1949 Ringler
2,509,289 A 5/1950 Dunning
2,757,851 A 8/1956 Moore
3,133,688 A 5/1964 Asman
3,300,115 A 1/1967 Schauer
3,352,053 A * 11/1967 Anderson ..... A01M 25/004 229/120.08
3,355,089 A 11/1967 Champlin
3,363,822 A 1/1968 Maulini et al.
3,426,955 A 2/1969 Olson
3,522,905 A * 8/1970 Wei ..... B65D 5/54 229/172
3,669,345 A 6/1972 Cote
3,680,766 A 8/1972 Collura et al.
3,690,544 A 9/1972 Meyers
3,768,719 A 10/1973 Johnson
3,971,503 A * 7/1976 Allan ..... B65D 5/6602 294/1.3
4,180,167 A * 12/1979 Leavitt ..... B65D 5/742 229/218
4,191,324 A 3/1980 Kitagawa
4,252,267 A 2/1981 Osborne
4,313,553 A 2/1982 Lisiecki
4,344,537 A 8/1982 Austin
4,508,218 A 4/1985 Focke et al.
4,558,785 A 12/1985 Gordon
4,645,108 A 2/1987 Gavin et al.
4,676,394 A 6/1987 Hiersteiner
4,762,234 A 8/1988 Wyberg
4,905,898 A 3/1990 Wade
5,255,494 A 10/1993 Doyle
5,292,058 A 3/1994 Zoss et al.
5,326,024 A 7/1994 Fogle
5,346,121 A * 9/1994 Beales ..... B65D 5/0254 229/148
5,347,865 A 9/1994 Mulry et al.
5,501,394 A 3/1996 Eno
5,632,402 A 5/1997 Walsh et al.
5,632,404 A 5/1997 Walsh
5,746,871 A 5/1998 Walsh
5,783,030 A 7/1998 Walsh
5,794,811 A 8/1998 Walsh
5,794,812 A 8/1998 Walsh
5,816,487 A 10/1998 Skinner
5,857,614 A 1/1999 Walsh
5,918,799 A 7/1999 Walsh
5,988,494 A 11/1999 Fontaine
5,996,882 A 12/1999 Randall
6,050,484 A 4/2000 Galomb
6,062,467 A 5/2000 Ours et al.
6,102,277 A 8/2000 Krapohl, Sr.
6,145,736 A 11/2000 Ours et al.
6,164,821 A 12/2000 Randall
6,206,279 B1 3/2001 Countee
6,352,096 B1 3/2002 Walsh
6,364,202 B1 4/2002 Zelley
6,419,151 B1 7/2002 Urtubey
6,854,639 B2 2/2005 Walsh
6,929,172 B2 8/2005 Bates et al.
7,025,504 B2 4/2006 Olin
7,036,714 B2 5/2006 Walsh et al.
7,210,612 B2 5/2007 Walsh et al.
7,331,509 B2 2/2008 Bates et al.
7,617,969 B2 11/2009 Oliveira
7,913,897 B2 3/2011 Manaige
8,672,214 B2 3/2014 Manaige
8,770,469 B2 7/2014 Burke et al.
9,346,582 B2 5/2016 Pinkstone
9,758,275 B2 9/2017 Fitzwater
9,771,176 B2 9/2017 Kastanek
9,809,373 B2 11/2017 Gallimore
2001/0002677 A1 6/2001 Grabher
2001/0048022 A1 12/2001 Zoeckler
2002/0055429 A1 5/2002 Walsh
2003/0144121 A1 7/2003 Walsh et al.
2004/0102748 A1 5/2004 Hirotsu
2004/0112948 A1 6/2004 Bone
2004/0226989 A1 11/2004 Cook et al.
2005/0127150 A1 6/2005 Walsh et al.
2005/0187087 A1 8/2005 Walsh
2005/0199695 A1 9/2005 DeBusk et al.
2005/0209576 A1 9/2005 Hirotsu
2005/0274782 A1 12/2005 Petrelli et al.
2006/0054675 A1 3/2006 Bennett
2006/0243783 A1 11/2006 Spivey, Sr. et al.
2006/0255107 A1 11/2006 Wright
2007/0194093 A1 8/2007 Ford
2008/0290149 A1* 11/2008 Sweet ..... B65D 5/0263 493/137
2008/0296360 A1 12/2008 Abel et al.
2010/0282829 A1 11/2010 Jackson
2011/0068159 A1* 3/2011 Yamada ..... B65D 5/103 229/138
2015/0368019 A1 12/2015 Pinkstone
2017/0113832 A1 4/2017 Faulkner
2017/0225822 A1 8/2017 Cooper et al.
2018/0118405 A1* 5/2018 Walling ..... B65D 5/4608

FOREIGN PATENT DOCUMENTS

DE 87 08 078.8 10/1987
DE 94 13 813 10/1994
EP 1 457 425 9/2004
FR 2 699 150 6/1994
FR 2 755 670 5/1998
GB 104445 3/1917
GB 1 242 356 8/1971
GB 1 489 963 10/1977
GB 1 584 066 2/1981
GB 2 363 372 12/2001
JP 05-029917 U 4/1993
JP 2009-137596 A 6/2009
JP 2010-013141 A 1/2010
KR 20-1998-0019535 7/1998
KR 10-0211329 8/1999
KR 10-0354924 10/2002
KR 10-2004-0004669 1/2004
KR 10-2005-0013599 2/2005
KR 20-2009-0000571 U 1/2009
KR 10-2016-0058413 A 5/2016
WO WO 85/00791 A1 2/1985
WO WO 95/28325 10/1995
WO WO 2006/124643 11/2006
WO WO 2006/133401 12/2006
WO WO 2007/050722 A1 5/2007

* cited by examiner

CARTON WITH RECLOSABLE FEATURES

CROSS-REFERENCE TO RELATED APPLICATION

This application claims the benefit of U.S. Provisional Patent Application No. 63/307,313, filed on Feb. 7, 2022.

INCORPORATION BY REFERENCE

The disclosure of U.S. Provisional Patent Application No. 63/307,313, filed on Feb. 7, 2022, is hereby incorporated by reference for all purposes as if presented herein in its entirety.

BACKGROUND

The present disclosure generally relates to cartons for holding and dispensing articles.

SUMMARY

According to one aspect, the disclosure is generally directed to a carton for holding at least one article, the carton comprising a plurality of panels extending at least partially around an interior of the carton, the plurality of panels comprising a plurality of side panels, a plurality of end flaps foldably connected to a respective panel of the plurality of panels, the plurality of end flaps at least partially overlapped to form at least one reclosable end of the carton, the plurality of end flaps comprising at least one top end flap foldably connected to at least one side panel of the plurality of side panels, the at least one top end flap comprising a base portion foldably connected to a distal portion, and a reconfigurable lid comprising the at least one top end flap, the reconfigurable lid for at least partially overlying the interior of the carton when the carton is in an open configuration, the reconfigurable lid for forming a dispenser when the carton is in a closed configuration.

According to another aspect, the disclosure is generally directed to a blank for forming a carton for holding at least one article, the blank comprising a plurality of panels for extending at least partially around an interior of the carton formed from the blank, the plurality of panels comprising a plurality of side panels, a plurality of end flaps foldably connected to a respective panel of the plurality of panels, the plurality of end flaps for being at least partially overlapped to form at least one reclosable end of the carton formed from the blank, the plurality of end flaps comprising at least one top end flap foldably connected to at least one side panel of the plurality of side panels, the at least one top end flap comprising a base portion foldably connected to a distal portion, and the at least one top end flap for forming a reconfigurable lid of the carton formed from the blank, the reconfigurable lid for at least partially overlying the interior of the carton when the carton formed from the blank is in an open configuration, the reconfigurable lid for forming a dispenser when the carton formed from the blank is in a closed configuration.

According to another aspect, the disclosure is generally directed to a method of forming a carton for holding at least one article, the method comprising obtaining a blank comprising a plurality of panels and a plurality of end flaps foldably connected to a respective panel of the plurality of panels, the plurality of panels comprising a plurality of side panels, the plurality of end flaps comprising at least one top end flap foldably connected to at least one side panel of the plurality of side panels, the at least one top end flap comprising a base portion foldably connected to a distal portion, folding the plurality of panels at least partially around an interior of the carton, at least partially overlapping the plurality of end flaps to form at least one reclosable end of the carton, and positioning the at least one top end flap to form a reconfigurable lid, the reconfigurable lid for at least partially overlying the interior of the carton when the carton is in an open configuration, the reconfigurable lid for forming a dispenser when the carton is in a closed configuration.

Those skilled in the art will appreciate the above-stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION

Cartons according to the present disclosure can accommodate articles of numerous different shapes. For the purpose of illustration and not for the purpose of limiting the scope of the disclosure, the following detailed description describes articles such as food products. Such food products can be provided in discrete or granular portions, e.g., as in snacks, for example, candy, gum, chocolate, granola, cereal, nuts, trail mix, raisins, dried fruit, etc. It will be understood that a different type of article such as a different type of food product can be held in cartons according to the present disclosure without departing from the disclosure. It will be further understood that articles other than food products can be held in cartons according to the present disclosure.

In this specification, the terms "lower," "bottom," "upper," and "top" indicate orientations determined in relation to fully erected and upright cartons. As described herein, cartons can be formed from blanks by overlapping multiple panels, portions, and/or end flaps. Such panels, portions and/or end flaps may be designated herein in terms relative to one another, e.g., "first", "second", "third", etc., in sequential or non-sequential reference, without departing from the disclosure.

Figure 1:
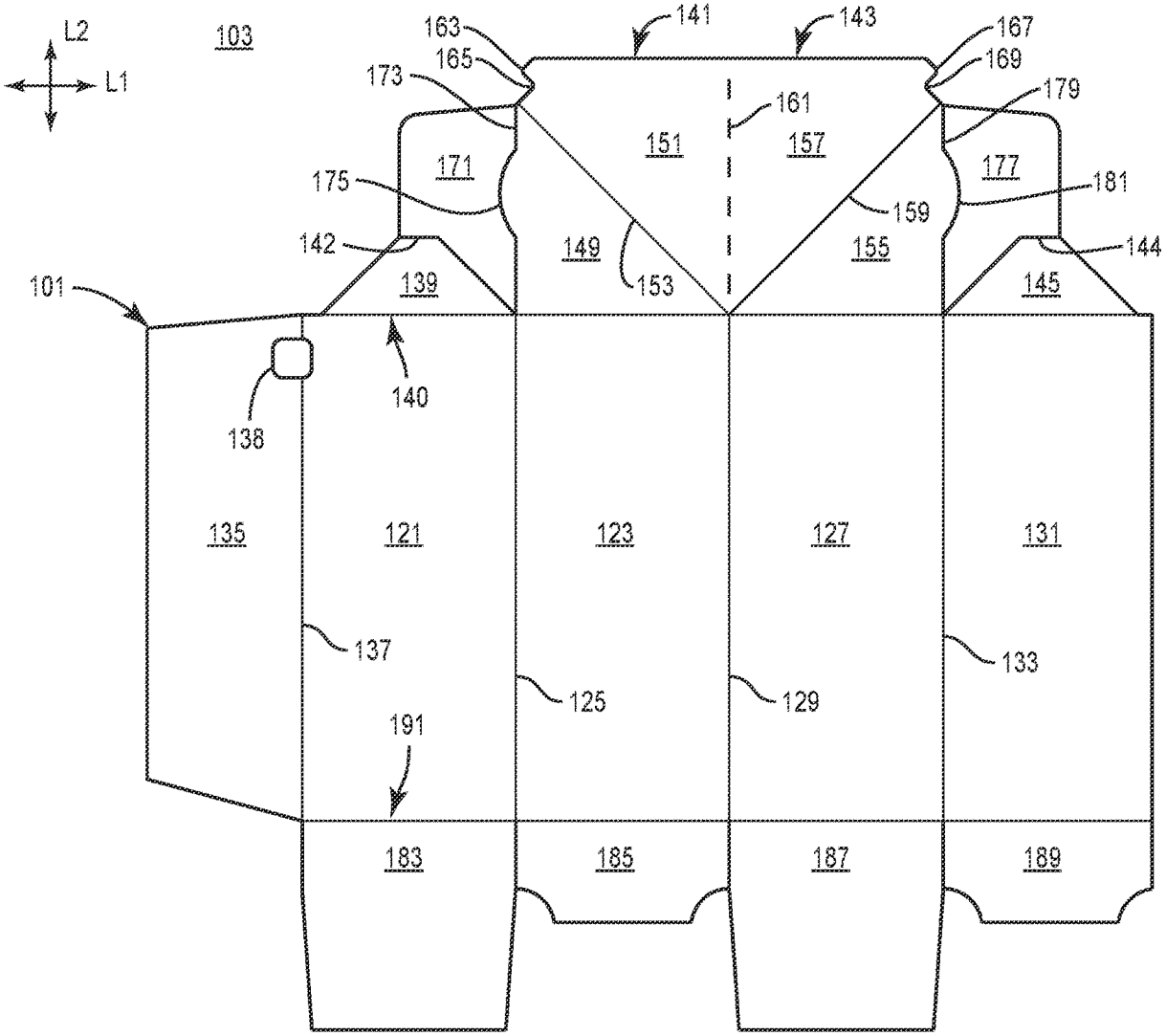
FIG. 1 is a plan view of an exterior surface of a blank used to form a carton according to an exemplary embodiment of the disclosure.

FIG. 1 is a plan view of an exterior surface 101 of a blank, generally indicated at 103, used to form a container or carton 105 (FIG. 2) according to an exemplary embodiment of the disclosure. As described further herein, the carton 105 can be provided with access features that facilitate reconfiguration of the carton 105 between a first or open configuration of the carton 105, in which at least one reclosable end of the carton 105 provides access to the interior 107 of the carton 105, and a second or closed configuration of the carton 105, in which the at least one reclosable end of the carton 105 restricts access to the interior 107 of the carton 105. As also described herein, a reconfigurable lid 113 (FIG. 2) can facilitate transition of the carton 105 between the open configuration and the closed configuration.

As shown in FIG. 1, the blank 103 can have a longitudinal axis L1 and a lateral axis L2, and a plurality of panels for extending at least partially around the interior 107 of the carton 105 formed from the blank 103. In the illustrated embodiment, the plurality of panels of the carton 105/blank 103 can include a first side panel 121, a second side panel 123 foldably connected to the first side panel 121 at a lateral fold line 125, a third side panel 127 foldably connected to the second side panel 123 at a lateral fold line 129, and a fourth side panel 131 foldably connected to the third side panel 127 at a lateral fold line 133. An attachment flap or attachment panel 135 can be foldably connected to the first side panel 121 at a lateral fold line 137 that is interrupted by a locking opening 138 that is defined at least partially in the attachment flap 135 and at least partially in the first side panel 121, as described further herein.

The blank 103 can also include a plurality of end flaps for forming at least one closed end of the carton 105. The end flaps can include a top end flap 139 (broadly, "third top end flap" or "fourth top end flap") foldably connected to the first side panel 121 at a respective portion of a longitudinal fold line 140, a top end flap 141 (broadly, "first top end flap" or "second top end flap") foldably connected to the second side panel 123 at a respective portion of the longitudinal fold line 140, a top end flap 143 (broadly, "first top end flap" or "second top end flap") foldably connected to the third side panel 127 at a respective portion of the longitudinal fold line 140, and a top end flap 145 (broadly, "third top end flap" or "fourth top end flap") foldably connected to the fourth side panel 131 at a respective portion of the longitudinal fold line 140. The end flaps 139, 141, 143, 145 can be for being at least partially overlapped to form a reclosable first end 109 of the carton 105 formed form the blank 103. As discussed herein, the end flaps 141, 143 can be for at least partially forming the reclosable lid 113 (FIG. 2) of the carton 105.

The top end flap 141, as shown, can include a base portion 149 foldably connected to the second side panel 123 at the respective portion of the fold line 140 and a distal portion 151 foldably connected to the base portion 149 at an oblique fold line 153. Similarly, the top end flap 143 can include a base portion 155 foldably connected to the third side panel 127 at the respective portion of the fold line 140 and a distal portion 157 foldably connected to the base portion 155 at an oblique fold line 159. As also shown, the distal portion 151 of the top end flap 141 and the distal portion 157 of the top end flap 143 can be foldably connected at a longitudinal fold line 161 that intersects the oblique fold lines 153, 159 and the fold line 129.

Each distal portion 151, 157 of the respective top end flaps 141, 143 defines a respective locking protrusion 163, 167 adjacent a respective notch 165, 169. As described further herein, the locking protrusions 163, 167 and/or notches 165, 169 can cooperate with the locking opening 138 to form locking features of the blank 103/carton 105.

A top attachment flap 171 can be foldably and separably connected to the top end flap 141 at a lateral line of weakening 173 that is interrupted by a curved cut 175. Similarly, a top attachment flap 177 can be foldably and separably connected to the top end flap 143 at a lateral line of weakening 179 that is interrupted by a curved cut 181. The top end flap 139 can be separated from the top attachment flap 171 at a cut 142 having one or more curved, straight, and/or angled segments, and the top end flap 145 can be separated from the top attachment flap 177 at a cut 144 having one or more curved, straight, and/or angled segments.

Still referring to FIG. 1, the end flaps can include a bottom end flap 183 foldably connected to the first side panel 121 at a respective portion of a longitudinal fold line 191, a bottom end flap 185 foldably connected to the second side panel 123 at a respective portion of the fold line 191, a bottom end flap 187 foldably connected to the third side panel 127 at a respective portion of the fold line 191, and a bottom end flap 189 foldably connected to the fourth side panel 131 at a respective portion of the fold line 191. As described further herein, the end flaps 183, 185, 187, 189 can be for being at least partially overlapped to form a closed second end 111 of the carton 105 formed form the blank 103.

The blank 103 also includes access features for facilitating reconfiguration of the carton 105 between an open configuration of the carton 105, in which the end 109 provides access to the interior 107 of the carton 105, and a closed configuration of the carton 105, in which the end 109 of the carton 105 restricts access to the interior 107 of the carton 105. As described further herein, the access features can comprise one or more of the top attachment flaps 171, 177 and respective portions of the top end flaps 141, 143.

Figure 2:
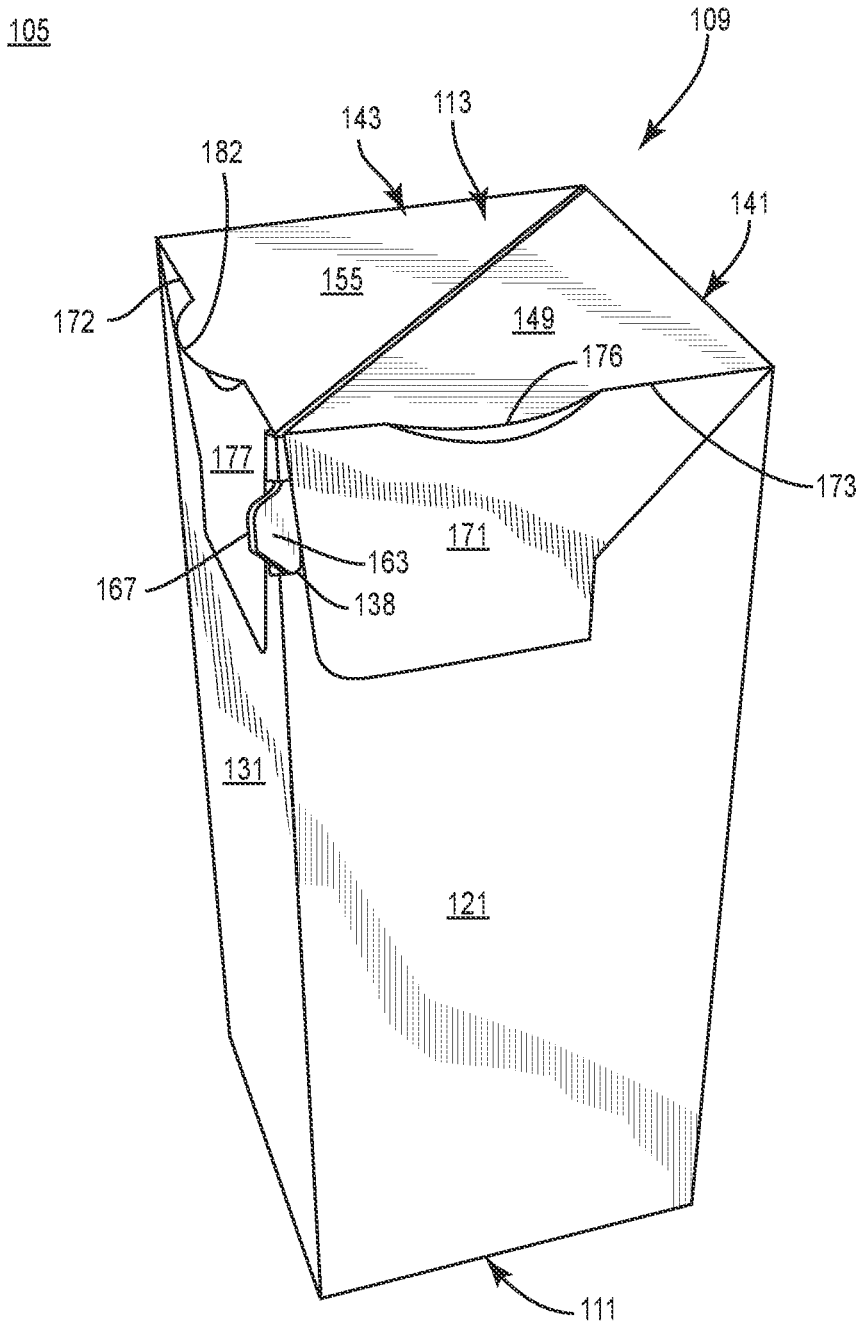
FIG. 2 is a perspective view of a carton formed from the blank of FIG. 1 and in a closed configuration according to an exemplary embodiment of the disclosure.

Referring additionally to FIG. 2, formation of the carton 105 from the blank 103 will be described according to an exemplary embodiment of the disclosure. The blank 103 can be positioned with the exterior surface 101 thereof in contact with a supporting surface, e.g., in a face-down orientation, and with an interior surface facing upwardly, the interior surface being opposite the exterior surface 101 of the blank 103 and the carton 105 formed therefrom.

The panels 121, 123, 127, 131 can be folded at the fold lines 125, 129, 133 at least partially around the interior 107 of the carton 105 and to position the first side panel 121 and the third side panel 127 in generally spaced and parallel relation and to position the second side panel 123 and the fourth side panel 131 in generally spaced and parallel relation, with the first side panel 121 and third side panel 127 extending from the second side panel 123 to the fourth side panel 131.

The attachment flap 135 can be folded at the fold line 137 and positioned in at least partial face-to-face contact with the fourth side panel 131. The aforementioned arrangement of the carton 105 can be maintained with one or more applications of an adhesive such as glue.

The end flaps 183, 185, 187, 189 can be folded at respective portions of the fold line 191 into at least partial overlapping relation to form the second closed end 111 of the carton 105. In one embodiment, the second end 111 of the carton 105 can be maintained in the closed configuration with one or more applications of an adhesive such as glue.

To close the first end 109 of the carton 105, the top end flaps 139, 145 can be folded at respective portions of the fold line 140 toward the interior 107 of the carton 105.

Simultaneously or thereafter, the top end flaps 141, 143 can be folded downwardly at respective portions of the fold line 140 toward the interior 107 of the carton 105. As the top end flaps 141, 145 fold downwardly, the distal portion 151 of the top end flap 141 can be folded relative to the base portion 149 of the top end flap 141 and the distal portion 157 of the top end flap 143 can be folded relative to the base portion 155 of the top end flap 143 at the fold line 159 such that the distal portions 151, 157 extend obliquely or perpendicularly away from the respective base portions 149, 155. Such movement of the top end flaps 141, 143 may involve relative movement of the distal portions 151, 157 via at least partial folding at the fold line 161.

The top attachment flaps 171, 177 can be folded at the respective fold lines 173, 177 into at least partial face-to-face contact with portions of the respective side panels 121, 131. As the top attachment flaps 171, 177 fold at the respective fold lines 173, 177, protruding portions of the respective base portions 149, 155 separate therefrom at the respective curved cuts 175, 181 to define respective user engagement tabs 176, 182 extending from the respective top end flaps 141, 143 and the end 109 of the carton 105, extending outwardly and away from the interior 107 of the carton 105.

It will be understood that one or more articles P (FIG. 4) can be inserted into the interior 107 of the carton 105 following the closure of one of the ends 109, 111 of the carton 105. For example, in one embodiment, the closed end 111 can be formed via at least partial overlapping of the end flaps 183, 185, 187, 189 as described above, and one or more articles P can be inserted into the interior 107 of the carton 105 prior to closure of the top end 109 of the carton 105. In another embodiment, the top end 109 of the carton 105 can be closed as described above, and one or more articles P can be inserted into the interior 107 of the carton 105 with the carton 105 in an inverted orientation prior to closure of the bottom end 111 of the carton 105.

In the initially closed configuration of the carton 105/end 109, the top end flaps 139, 145 can be positioned in generally perpendicular relation to the respective side panels 121, 131, the base portions 149, 155 of the respective top end flaps 141, 143 can be positioned in at least partial overlying and/or face-to-face contact with the respective top end flaps 139, 145, and the distal portions 151, 157 of the respective top end flaps 141, 143 can be positioned extending generally downwardly from the respective base portions 149, 155 into the interior 107 of the carton 105. In such an arrangement, the distal portions 151, 157 of the respective top end flaps 141, 143 can be folded at the fold line 161 into at least partial face-to-face contact with one another and extending downwardly between a gap 193 defined between the top end flaps 139, 145 so as to be at least partially positioned in the interior 107 of the carton 105.

In this regard, at least the top end flaps 141, 143 can cooperate to form a reconfigurable lid 113 of the carton 105 that overlies and at least partially restricts access to the interior 107 of the carton 105 when the top end 109/carton 105 is in the closed configuration, and which is reconfigurable to form a dispenser or spout when the top end 109/carton 105 is in the open configuration.

As described above, the top attachment flaps 171, 177 can be positioned in at least partial face-to-face contact with the respective side panels 121, 131 along an exterior surface of the carton 105. In one embodiment, the top attachment flaps 171, 177 can attached to the respective side panels 121, 131 with an adhesive such as glue.

In such arrangement, the locking protrusions 163, 167 of the respective top end flaps 141, 143 can be positioned extending at least partially through the locking opening 138, with the respective notches 165, 169 at least partially receiving respective portions of the panel 121/flap 135 adjacent the locking opening 138. Such action/positioning of the locking protrusions 163, 167 and associated features can facilitate maintenance of the end 109/carton 105 in the closed configuration.

Figure 3:
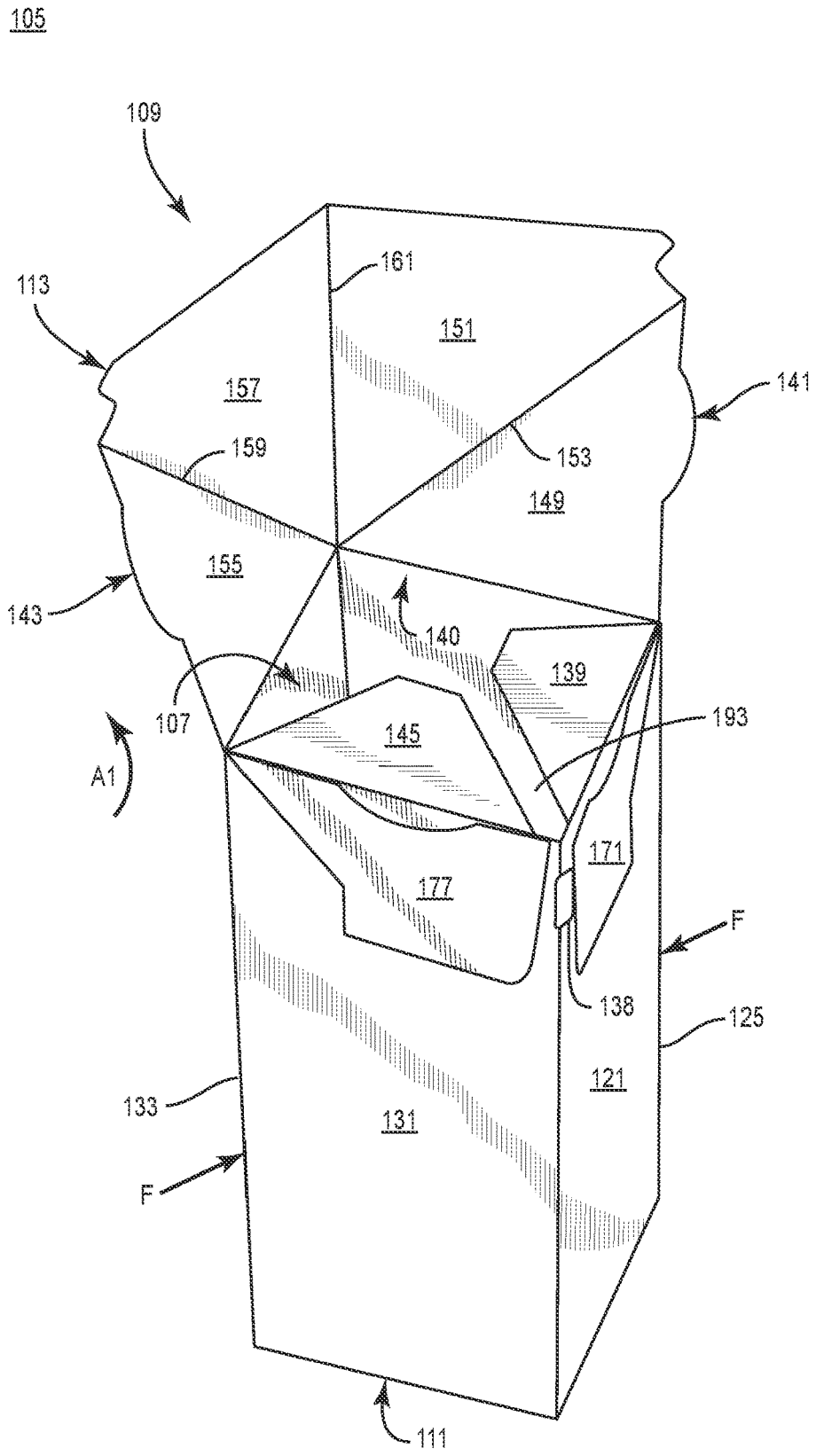
FIG. 3 is a perspective view of a carton formed from the blank of FIG. 1 and in an open configuration according to an exemplary embodiment of the disclosure.

With additional reference to FIG. 3, reconfiguration of the end 109/carton 105 from the initial closed configuration to an open configuration will be described according to an exemplary embodiment of the disclosure.

When it is desired to open the end 109/carton 105, a user can separate the top end flaps 141, 143 from the respective top attachment flaps 171, 177 at the respective lines of weakening 173, 179. In one embodiment, a user can engage the user engagement tabs 176, 182 with one or more of his or her fingers and lift upwardly to cause such separation of the top end flaps 141, 143 from the respective top attachment flaps 171, 177.

Simultaneously or thereafter, the locking protrusions 163, 167 can be withdrawn from the locking opening 138. In one embodiment, opposing surfaces of the carton 105 can be squeezed by the user, e.g., via manual exertion of a compressive force F proximate the fold lines 125, 133 to cause at least partial deformation, e.g., twisting, bending, flexing, etc., of one or more portions of the carton 105 to urge the top end flaps 141, 143 upwardly away from the carton 105, with the locking protrusions 163, 167 being incidentally withdrawn from the locking opening 138 during such movement of the top end flaps 141, 143.

Additionally or alternatively, the locking protrusions 163, 167 and/or other portions of the top end flaps 141, 143 can be directly engaged by a user to facilitate such disengagement from the locking opening 138.

As the top end flaps 141, 143 are raised (e.g., via squeezing of the carton 105 by a user and/or via direct engagement of the top end flaps 141, 143 by the user) in the direction of the arrow A1, the distal portion 151 of the top end flap 141 can be folded relative to the base portion 149 of the top end flap 141 at the fold line 153 and the distal portion 157 of the top end flap 143 can be folded relative to the base portion 155 of the top end flap 143 at the fold line 159. Such movement of the top end flaps 141, 143 can involve relative movement of the distal portions 151, 157 via at least partial folding at the fold line 161.

Figure 4:
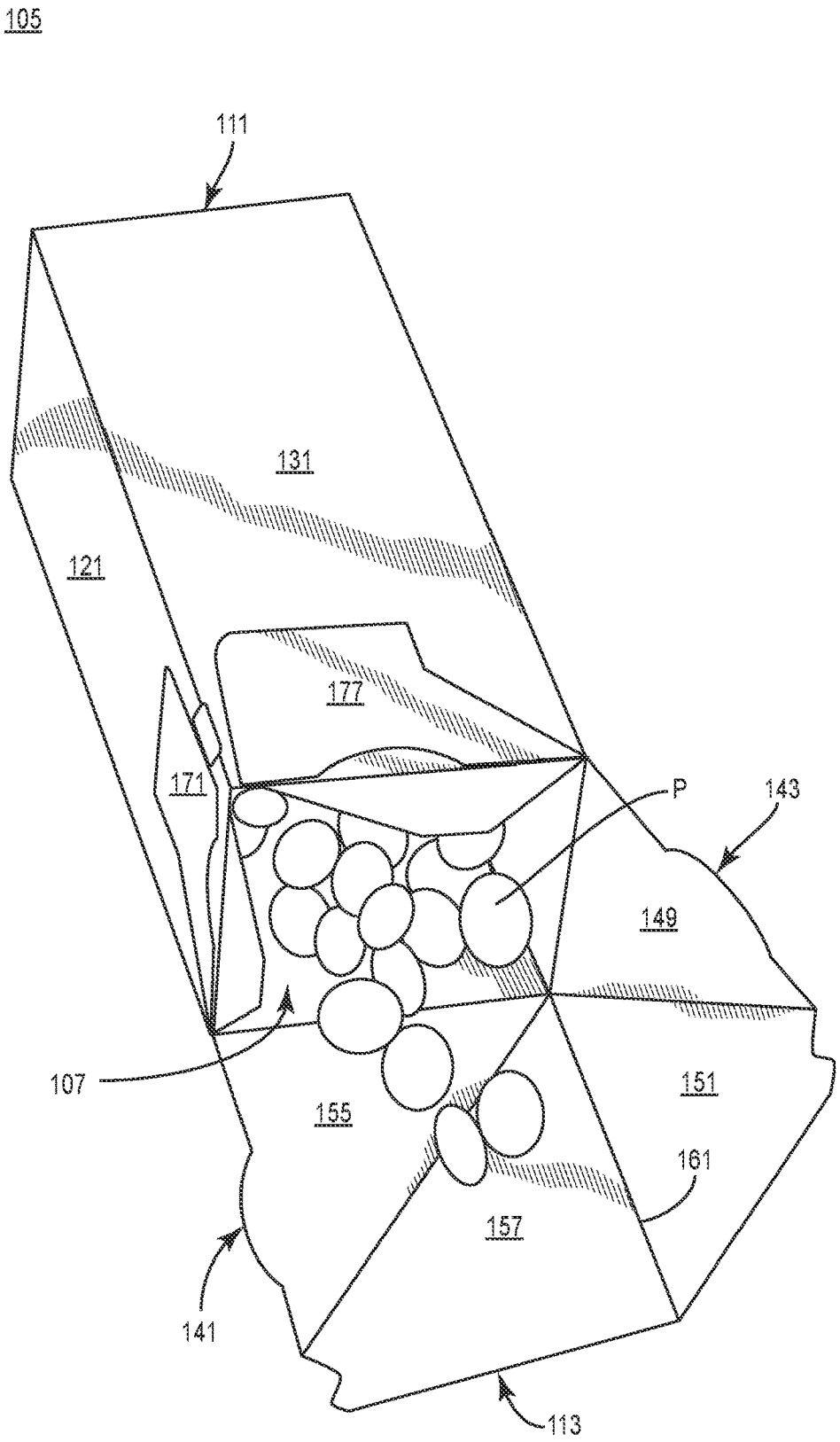
FIG. 4 is a perspective view of a carton formed from the blank of FIG. 1 and in an open configuration and dispensing articles according to an exemplary embodiment of the disclosure.

In this regard, and as shown in FIG. 4, the reconfigurable lid 113 of the carton 105 can be reconfigured, with the top end flaps 141, 143 can be selectively arranged (e.g., unfolded) to form a dispenser or spout along which one or more articles P from the interior 107 of the carton 105 can slide, roll, be shaken, etc., to provide a controlled distribution of articles P from the interior 107 of the carton 105. As shown, the top end flaps 141, 143 can be obliquely arranged relative to one another to form a dispenser chute or dispenser path extending away from the panels 121, 123, 127, 131.

Figure 5:
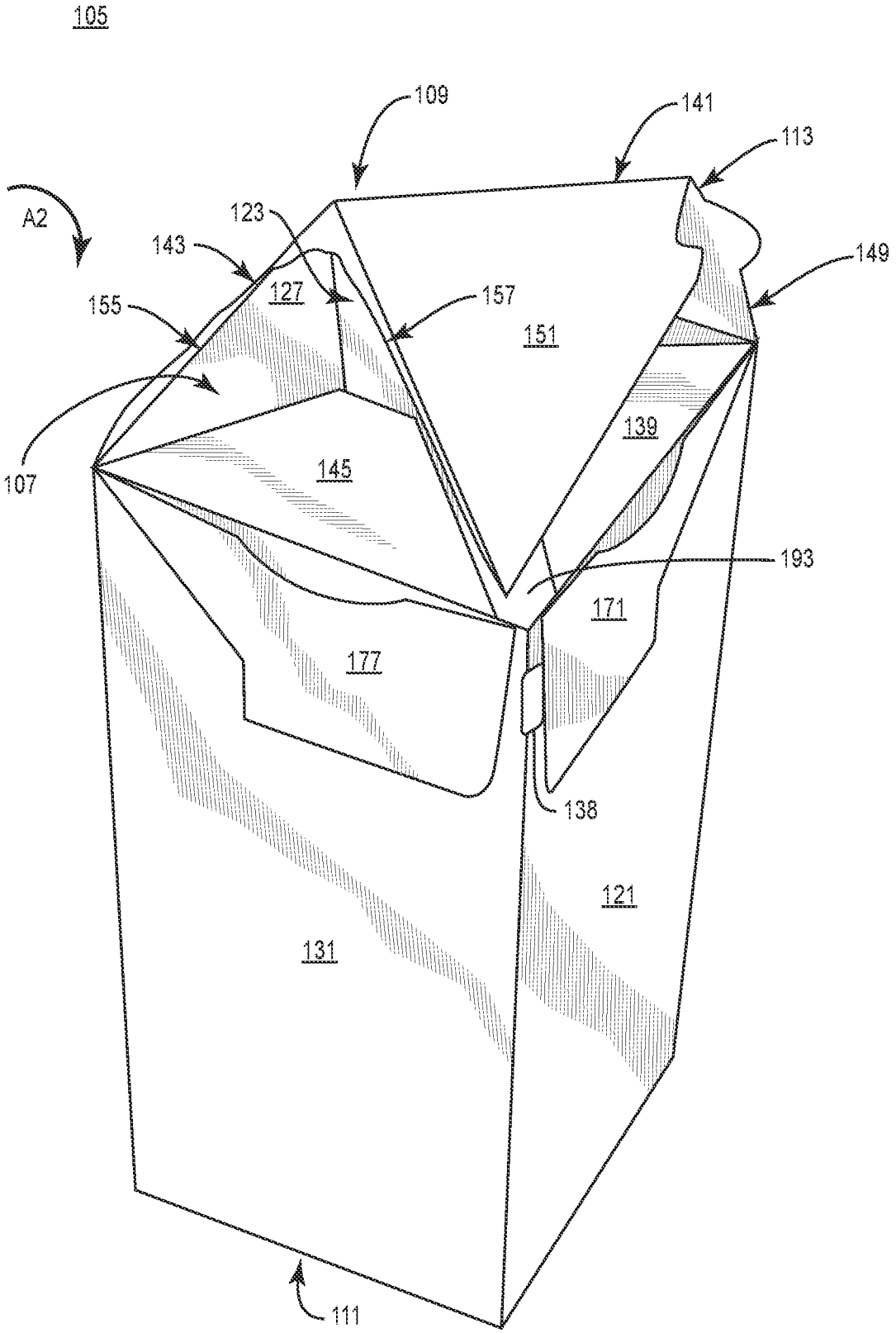
FIG. 5 is a perspective view of a carton formed from the blank of FIG. 1 and in a partially reclosed configuration according to an exemplary embodiment of the disclosure, with a portion thereof broken away.

Turning to FIG. 5, when it is desired to reclose the top end 109/carton 105, e.g., from the open configuration after initial opening of the end 109/carton 105 as described above, the reconfigurable lid 113/top end flaps 141, 143 can be folded downwardly in the direction of the arrow A2 at respective portions of the fold line 140 toward the interior 107 of the carton 105. As the top end flaps 141, 145 fold downwardly, the distal portion 151 of the top end flap 141 can be folded relative to the base portion 149 of the top end flap 141 at the fold line 153 and the distal portion 157 of the top end flap 143 can be folded relative to the base portion 155 of the top end flap 143 at the fold line 159 such that the distal portions 151, 157 extend obliquely or perpendicularly away from the respective base portions 149, 155. Such movement of the top end flaps 141, 143 can involve relative movement of the distal portions 151, 157 via at least partial folding at the fold line 161.

In this regard, in the reclosed configuration of the carton 105/end 109, the top end flaps 139, 145 can be positioned in generally perpendicular relation to the respective side panels 121, 131, the base portions 149, 155 of the respective top end flaps 141, 143 can be positioned in at least partial overlying and/or face-to-face contact with the respective top end flaps 139, 145, and the distal portions 151, 157 can be positioned extending generally downwardly from the respective base portions 149, 155 into the interior 107 of the carton 105 as described above with regard to the initially closed configuration of the top end 109/carton 105.

The locking protrusions 163, 167 of the respective top end flaps 141, 143 can also be positioned at least partially extending through the locking opening 138 so as to maintain the closed configuration of the end 109/carton 105. Such a configuration is similar to that described above with regard to the initial closed configuration of the end 109/carton 105, with the exception that the top end flaps 141, 143 remain separated from the top attachment flaps 171, 177, and thus such the need for such separation is obviated when it is desired to again open the end 109/carton 105. In this regard, the top end flaps 141, 143 can together form a lid of the carton 105 that can be selectively raised and lowered to access or restrict access to the interior 107 of the carton 105.

In view of the foregoing, the blank 103/carton 105 is reconfigurable between an open configuration of the carton 105, in which at least one reclosable end of the carton 105 provides access to the interior 107 of the carton 105, and a closed configuration of the carton 105, in which the at least one reclosable end of the carton 105 restricts access to the interior 107 of the carton 105.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blanks. In accordance with the above-described embodiments, the blank may be constructed of paperboard of a caliper such that it is heavier and more rigid than ordinary paper. The blanks can also be constructed of other materials, such as cardboard, hard paper, or any other material having properties suitable for enabling the cartons, to function at least generally as described above. The blanks can also be laminated to or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type of tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the spaced apart slits to be replaced with a continuous slit, a continuous score, or the like. For example, a cut line can be a continuous slit or could be wider than a slit without departing from the present disclosure. Also, a tear line can be a series of cut scores passing completely, or partially, through the material, that are separated by nicks.

The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding at least one article, the carton comprising:

a plurality of panels extending at least partially around an interior of the carton, the plurality of panels comprising a plurality of side panels;

a plurality of end flaps foldably connected to a respective panel of the plurality of panels, the plurality of end flaps at least partially overlapped to form at least one reclosable end of the carton, the plurality of end flaps comprising a first top end flap foldably connected to at least one side panel of the plurality of side panels and a second top end flap foldably connected to the first top end flap, each of the first top end flap and the second top end flap comprising a base portion foldably connected to a distal portion;

a reconfigurable lid comprising the first top end flap and the second top end flap, the reconfigurable lid for at least partially overlying the interior of the carton when the carton is in a closed configuration, the reconfigurable lid for forming a dispenser when the carton is in an open configuration;

access features for facilitating reconfiguration of the carton between the open configuration of the carton, in which the reconfigurable lid is for providing access to the interior of the carton, and the closed configuration of the carton, in which the reconfigurable lid is for restricting access to the interior of the carton, the access features comprising a top attachment flap separably connected to the first top end flap and attached to a respective side panel of the plurality of side panels;

wherein at least a portion of the first top end flap is for being positioned in the interior of the carton when the carton is in the closed configuration;

wherein the distal portion of the first top end flap is for extending downwardly from the base portion of the first top end flap into the interior of the carton when the carton is in the closed configuration;

wherein the distal portion of the second top end flap is for extending downwardly from the base portion of the second top end flap into the interior of the carton when the carton is in the closed configuration, and wherein the distal portion of the first top end flap is foldably connected to the distal portion of the second top end flap, wherein the distal portion of the first top end flap is for being positioned in at least partial face-to-face contact with the distal portion of the second top end flap when the carton is in the closed configuration.

2. The carton of claim 1, wherein the top attachment flap is for being connected to the first top end flap when the carton is in the closed configuration, and the top attachment flap is for being separated from the first top end flap when the carton is in the open configuration.

3. The carton of claim 2, wherein the access features comprise a user engagement tab extending outwardly from the first top end flap.

4. The carton of claim 3, the first top end flap for being obliquely arranged relative to the second top end flap when the reconfigurable lid forms the dispenser when the carton is in the open configuration.

5. The carton of claim 1, wherein the dispenser extends away from a respective panel of the plurality of panels when the carton is in the open configuration.

6. The carton of claim 1, wherein the plurality of end flaps further comprises a third top end flap foldably connected to a respective side panel of the plurality of side panels and a fourth top end flap foldably connected to a respective side panel of the plurality of side panels, the distal portion of the first top end flap and the distal portion of the second top end flap are for extending downwardly between a gap between the third top end flap and the fourth top end flap when the carton is in the closed configuration.

7. The carton of claim 1, wherein the first top end flap is foldably connected to the second top end flap at a fold line.

8. The carton of claim 1, wherein the top attachment flap is separably connected to the first top end flap at a tear line.

9. A carton for holding at least one article, the carton comprising:

a plurality of panels extending at least partially around an interior of the carton, the plurality of panels comprising a plurality of side panels;

a plurality of end flaps foldably connected to a respective panel of the plurality of panels, the plurality of end flaps at least partially overlapped to form at least one reclosable end of the carton, the plurality of end flaps comprising at least one top end flap foldably connected to at least one side panel of the plurality of side panels, the at least one top end flap comprising a base portion foldably connected to a distal portion;

a reconfigurable lid comprising the at least one top end flap, the reconfigurable lid for at least partially overlying the interior of the carton when the carton is in a closed configuration, the reconfigurable lid for forming a dispenser when the carton is in an open configuration; and locking features for maintaining the closed configuration of the carton, the locking features comprising a locking protrusion extending from the at least one top end flap and a locking opening at least partially defined in at least one side panel of the plurality of side panels, the locking opening for at least partially receiving the locking protrusion.

10. A blank for forming a carton for holding at least one article, the blank comprising:

a plurality of panels for extending at least partially around an interior of the carton formed from the blank, the plurality of panels comprising a plurality of side panels;

a plurality of end flaps foldably connected to a respective panel of the plurality of panels, the plurality of end flaps for being at least partially overlapped to form at least one reclosable end of the carton formed from the blank, the plurality of end flaps comprising a first top end flap foldably connected to at least one side panel of the plurality of side panels and a second top end flap foldably connected to the first top end flap, each of the first top end flap and the second top end flap comprising a base portion foldably connected to a distal portion;

the first top end flap and the second top end flap for forming a reconfigurable lid of the carton formed from the blank, the reconfigurable lid for at least partially overlying the interior of the carton when the carton formed from the blank is in a closed configuration, the reconfigurable lid for forming a dispenser when the carton formed from the blank is in an open configuration;

access features for facilitating reconfiguration of the carton formed from the blank between the open configuration of the carton formed from the blank, in which the reconfigurable lid is for providing access to the interior of the carton formed from the blank, and the closed configuration of the carton formed from the blank, in which the reconfigurable lid is for restricting access to the interior of the carton formed from the blank, the access features comprising a top attachment flap separably connected to the first top end flap and for being attached to a respective side panel of the plurality of side panels when the carton is formed from the blank; and wherein the distal portion of the first top end flap is foldably connected to the distal portion of the second top end flap, wherein the distal portion of the first top end flap is for being positioned in at least partial face-to-face contact with the distal portion of the second top end flap when the carton formed from the blank is in the closed configuration.

11. The blank of claim 10, wherein the top attachment flap is for being connected to the first top end flap when the carton formed from the blank is in the closed configuration, and the top attachment flap is for being separated from the first top end flap when the carton formed from the blank is in the open configuration.

12. The blank of claim 11, wherein the access features comprise a user engagement tab extending outwardly from the first top end flap.

13. The blank of claim 10, wherein the first top end flap is foldably connected to the second top end flap at a fold line.

14. The blank of claim 10, wherein the top attachment flap Is separably connected to the first top end flap at a tear line.

15. A blank for forming a carton for holding at least one article, the blank comprising:

a plurality of panels for extending at least partially around an interior of the carton formed from the blank, the plurality of panels comprising a plurality of side panels;

a plurality of end flaps foldably connected to a respective panel of the plurality of panels, the plurality of end flaps for being at least partially overlapped to form at least one reclosable end of the carton formed from the blank, the plurality of end flaps comprising at least one top end flap foldably connected to at least one side panel of the plurality of side panels, the at least one top end flap comprising a base portion foldably connected to a distal portion;

the at least one top end flap for forming a reconfigurable lid of the carton formed from the blank, the reconfigurable lid for at least partially overlying the interior of the carton when the carton formed from the blank is in a closed configuration, the reconfigurable lid for forming a dispenser when the carton formed from the blank is in an open configuration; and locking features for maintaining the closed configuration of the carton formed from the blank, the locking features comprising a locking protrusion extending from the at least one top end flap and a locking opening at least partially defined in at least one side panel of the plurality of side panels, the locking opening for at least partially receiving the locking protrusion when the carton is formed from the blank.

16. A method of forming a carton for holding at least one article, the method comprising:

obtaining a blank comprising a plurality of panels and a plurality of end flaps foldably connected to a respective panel of the plurality of panels, the plurality of panels comprising a plurality of side panels, the plurality of end flaps comprising a first top end flap foldably connected to at least one side panel of the plurality of side panels and a second top end flap foldably connected to the first top end flap, each of the first top end flap and the second top end flap comprising a base portion foldably connected to a distal portion; and folding the plurality of panels at least partially around an interior of the carton; at least partially overlapping the plurality of end flaps to form at least one reclosable end of the carton;

positioning the first top end flap to form a reconfigurable lid, the reconfigurable lid for at least partially overlying the interior of the carton when the carton is in a closed configuration, the reconfigurable lid for forming a dispenser when the carton is in an open configuration;

access features for facilitating reconfiguration of the carton between the open configuration of the carton, in which the reconfigurable lid is for providing access to the interior of the carton, and the closed configuration of the carton, in which the reconfigurable lid is for restricting access to the interior of the carton, the access features comprising a top attachment flap separably connected to the first top end flap and attached to a respective side panel of the plurality of side panels;

positioning the distal portion of the first top end flap extending downwardly from the base portion of the first top end flap into the interior of the carton to form the closed configuration of the carton;

positioning the distal portion of the second top end flap extending downwardly from the base portion of the second top end flap into the interior of the carton to form the closed configuration of the carton; and wherein the distal portion of the first top end flap is foldably connected to the distal portion of the second top end flap, the method further comprising positioning the distal portion of the first top end flap in at least partial face-to-face contact with the distal portion of the second top end flap to form the closed configuration of the carton.

17. The method of claim 16, further comprising separating the top attachment flap from the first top end flap to form the open configuration of the carton.

18. The method of claim 17, wherein the access features comprise a user engagement tab extending outwardly from the first top end flap.

19. The method of claim 17, further comprising obliquely arranging the first top end flap relative to the second top end flap to form the dispenser.

20. The method of claim 16, wherein the dispenser extends away from a respective panel of the plurality of panels when the carton is in the open configuration.

21. The method of claim 16, wherein the plurality of end flaps further comprises a third top end flap foldably connected to a respective side panel of the plurality of side panels and a fourth top end flap foldably connected to a respective side panel of the plurality of side panels, the method further comprising positioning the third top end flap and the fourth top end flap to form a gap therebetween and positioning the distal portion of the first top end flap and the distal portion of the second top end flap extending downwardly between the gap to form the closed configuration of the carton.

22. The method of claim 16, wherein the first top end flap is foldably connected to the second top end flap at a fold line.

23. The method of claim 16, wherein the top attachment flap is separably connected to the first top end flap at a tear line.

24. A method of forming a carton for holding at least one article, the method comprising:

obtaining a blank comprising a plurality of panels and a plurality of end flaps foldably connected to a respective panel of the plurality of panels, the plurality of panels comprising a plurality of side panels, the plurality of end flaps comprising at least one top end flap foldably connected to at least one side panel of the plurality of side panels, the at least one top end flap comprising a base portion foldably connected to a distal portion;

folding the plurality of panels at least partially around an interior of the carton;

at least partially overlapping the plurality of end flaps to form at least one reclosable end of the carton; and positioning the at least one top end flap to form a reconfigurable lid, the reconfigurable lid for at least partially overlying the interior of the carton when the carton is in a closed configuration, the reconfigurable lid for forming a dispenser when the carton is in an open configuration; and locking features for maintaining the closed configuration of the carton, the locking features comprising a locking protrusion extending from the at least one top end flap and a locking opening at least partially defined in at least one side panel of the plurality of side panels, the method further comprising at least partially receiving the respective locking protrusion in the respective locking opening to form the closed configuration of the carton.

* * * * *